US010683599B2

(12) United States Patent
Kim et al.

(10) Patent No.: US 10,683,599 B2
(45) Date of Patent: Jun. 16, 2020

(54) WASHING MACHINE AND OPERATING METHOD FOR SAME

(71) Applicant: AMOTECH CO., LTD., Incheon (KR)

(72) Inventors: Byung Soo Kim, Anyang-si (KR); Hyung Hwan Ko, Anseong-si (KR); Hak Rok Kim, Daegu (KR); Se Ki Lee, Incheon (KR)

(73) Assignee: AMOTECH CO., LTD., Icheon (KR)

( * ) Notice: Subject to any disclaimer, the term of this patent is extended or adjusted under 35 U.S.C. 154(b) by 677 days.

(21) Appl. No.: 15/314,639

(22) PCT Filed: Jun. 15, 2015

(86) PCT No.: PCT/KR2015/006009
§ 371 (c)(1),
(2) Date: Nov. 29, 2016

(87) PCT Pub. No.: WO2016/003087
PCT Pub. Date: Jan. 7, 2016

(65) Prior Publication Data

US 2017/0191203 A1 Jul. 6, 2017

(30) Foreign Application Priority Data

Jun. 30, 2014 (KR) ..... 10-2014-0080936

(51) Int. Cl.

| | |
|---|---|
| ***D06F 37/40*** | (2006.01) |
| ***D06F 37/20*** | (2006.01) |
| ***D06F 37/24*** | (2006.01) |
| ***D06F 37/30*** | (2020.01) |

(52) U.S. Cl.
CPC ..... *D06F 37/40* (2013.01); *D06F 37/206* (2013.01); *D06F 37/24* (2013.01); *D06F 37/30* (2013.01); *D06F 37/304* (2013.01)

(58) Field of Classification Search
None
See application file for complete search history.

(56) References Cited

FOREIGN PATENT DOCUMENTS

| | | |
|---|---|---|
| JP | 2006517126 | 7/2006 |
| KR | 100548310 | 2/2006 |
| KR | 1020080092023 | 10/2008 |
| KR | 20140079699 | 6/2014 |
| KR | 1020140079259 | 6/2014 |
| KR | 1020140079699 A * | 6/2014 |

OTHER PUBLICATIONS

International Search Report—PCT/KR2015/006009 dated Aug. 27, 2015.

* cited by examiner

*Primary Examiner* — Michael E Barr
*Assistant Examiner* — Jason P Riggleman
(74) *Attorney, Agent, or Firm* — Cantor Colburn LLP

(57) ABSTRACT

Provided is a washing machine including: a washing tub connected with an outer rotor and an outer shaft; a pulsator connected with an inner rotor and an inner shaft; and a planetary gear set mounted between the inner rotor and the pulsator and between the outer rotor and the washing tub, to thus reduce a rotational force of the inner shaft, wherein at least one of the pulsator and the washing tub is rotated during performing a washing stroke by allowing the washing tub to be rotated for a period of time when the pulsator is stopping, to thus minimize a washing machine stop time during performing a washing stroke to thereby enhance a running rate and improve washing efficiency.

4 Claims, 8 Drawing Sheets

WASHING MACHINE AND OPERATING METHOD FOR SAME

TECHNICAL FIELD

The present invention relates to a washing machine that may drive a washing tub and a pulsator independently, to thus implement a dual-power, and a method of operating the same.

BACKGROUND ART

As disclosed in Korean Patent Registration Publication No. 10-0548310 (published on Oct. 24, 2006), a conventional washing machine includes: an outer case forming an outer shape; an outer tub which is supported on an inside of the outer case and receives wash water therein; an inner tub which is rotatably accommodated in an inside of the outer tub and is used for both washing and dehydrating; a pulsator which is mounted relatively rotatably in an inside of the inner tub, to thus form a washing water flow; a drive motor for generating a driving force for rotating the inner tub and the pulsator; an inner tub rotating shaft which receives the driving force of the drive motor thereby rotating the inner tub; a pulsator rotating shaft which receives the driving force of the drive motor thereby rotating the pulsator; a sun gear which is connected to the drive motor and is connected to the pulsator rotating shaft; a plurality of planetary gears which are simultaneously engaged with both the sun gear and a ring gear; a carrier supporting the planetary gears so as to be rotated and revolved; and a clutch spring for controlling the rotation of the inner tub and the pulsator during washing or dehydrating.

The conventional washing machine as described above has a planetary gear set including the sun gear, the ring gear, the planetary gears and the carrier, and reduces the rotational force of the drive motor, to then be transferred to the pulsator and the inner tub, and operates the clutch spring to selectively transmit power to the pulsator and the inner tub, to thus rotate only the pulsator or to thus rotate both the pulsator and the inner tub simultaneously.

However, since the conventional washing machine has a structure in which the pulsator and the inner tub can rotate only in an identical direction, the pulsator and the inner tub cannot be rotated in opposite directions to each other, to thus cause a problem that it is impossible to implement dual power.

Technical Problem

To solve the above problems or defects, it is an object of the present invention to provide a washing machine capable of independently driving a pulsator and a washing tub, to thus implement a dual-power to thereby form a variety of water flow patterns, and a method of operating the same.

It is another object of the present invention to provide a washing machine capable of simultaneously driving a pulsator and a washing tub, or driving only one of the pulsator and the washing tub, to thus minimize a washing machine stop time during performing a washing stroke to thereby enhance a running rate and improve washing efficiency, and a method of operating the same.

Technical Solution

To accomplish the above and other objects of the present invention, according to an aspect of the present invention, there is provided a washing machine comprising: a washing tub connected with an outer rotor and an outer shaft; a pulsator connected with an inner rotor and an inner shaft; and a planetary gear set mounted between the inner rotor and the pulsator and between the outer rotor and the washing tub, to thus reduce a rotational force of the inner shaft, wherein at least one of the pulsator and the washing tub is rotated during performing a washing stroke by allowing the washing tub to be rotated for a period of time when the pulsator is stopping in order to be rotated in a reverse direction.

Preferably but not necessarily, the inner shaft comprises: a first inner shaft connected to the inner rotor; and a second inner shaft connected to the pulsator, and the outer shaft comprises: a first outer shaft connected to the outer rotor; and a second outer shaft connected to the washing tub.

Preferably but not necessarily, the planetary gear set comprises: a ring gear that connects between the first outer shaft and the second outer shaft; a sun gear coupled to the first inner shaft; a planetary gear meshed with an outer surface of the sun gear and an inner surface of the ring gear; and a carrier rotatably supported by the planetary gear and connected to the second inner shaft.

Preferably but not necessarily, the outer rotor performs a braking action by using an electromagnetic brake or by allowing the outer rotor to rotate in the same direction as the inner rotor to thus transmit the rotational force of the inner rotor to the pulsator.

According to another aspect of the present invention, there is provided a method of operating a washing machine, the method comprising the steps of: rotating an inner rotor in a clockwise (CW) direction; transmitting a rotational force of the inner rotor to a pulsator, by using an electromagnetic brake in the outer rotor or by allowing the outer rotor to rotate in the same direction as the inner rotor; releasing the braking action of the outer rotor when a rotational time of the pulsator reaches a set time; and rotating the inner rotor in a counterclockwise (CCW) direction.

Preferably but not necessarily, the step of transmitting the rotational force of the inner rotor to the pulsator is characterized in that the ring gear connected to the outer rotor acts as a brake when the outer rotor acts as a brake, and an input applied to the sun gear connected to the inner rotor is outputted to a carrier associated with the pulsator through the planetary gear.

Preferably but not necessarily, when an RPM (Round Per Minute) of the outer rotor is a set value or above in the step of releasing the brake of the outer rotor, the RPM of the outer rotor is adjusted to maintain the set value or less.

Preferably but not necessarily, the ring gear performs the braking action, by using an electromagnetic brake in the outer rotor or by allowing the outer rotor to rotate in the same direction as the inner rotor.

Preferably but not necessarily, the pulsator and the washing tub are simultaneously rotated to implement dual-power in the step of transmitting the rotational force of the inner rotor to the pulsator.

Preferably but not necessarily, the step of releasing the braking action of the outer rotor is performed by releasing the electromagnetic brake of the outer rotor or by rotating the outer rotor.

Preferably but not necessarily, the method further comprises the step of adjusting the RPM of the outer rotor to allow the RPM of the outer rotor to maintain a set value or less when the RPM of the outer rotor is the set value or higher.

Advantageous Effects

As described above, in the washing machine of the present invention, the pulsator and the washing tub may be independently driven, to thereby implement a dual-power and form a variety of water flow patterns.

In addition, in the washing machine of the present invention and a method of operating the same, both the pulsator and the washing tub may be simultaneously driven or only one of the pulsator and the washing tub may be rotated, to thus minimize a washing machine stop time during performing a washing stroke to thereby enhance performance of the washing machine.

BEST MODE

Figure 1:
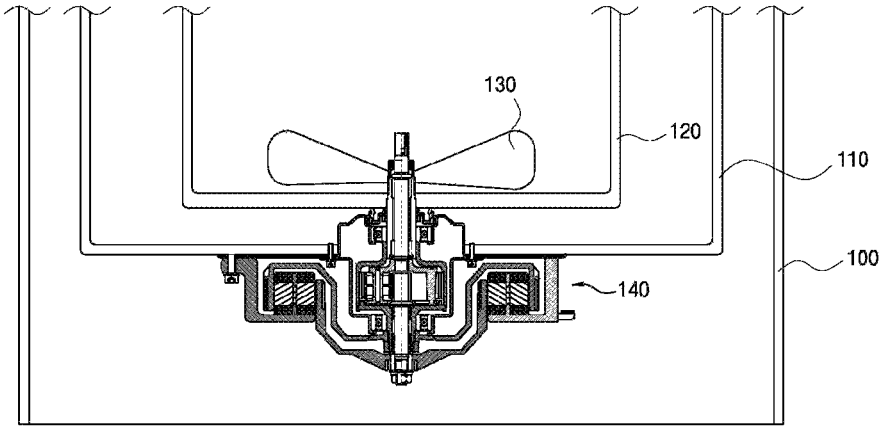
FIG. 1 is a cross-sectional view of a washing machine according to a first embodiment of the present invention.

Hereinafter, embodiments of the present invention will be described in detail with reference to the accompanying drawings. In the process, the size and shape of the components illustrated in the drawings may be shown exaggerated for convenience and clarity of explanation. Further, by considering the configuration and operation of the present invention the specifically defined terms may be changed according to user's or operator's intention, or the custom. Definitions of these terms herein need to be made based on the contents across the whole application.

Figure 2:
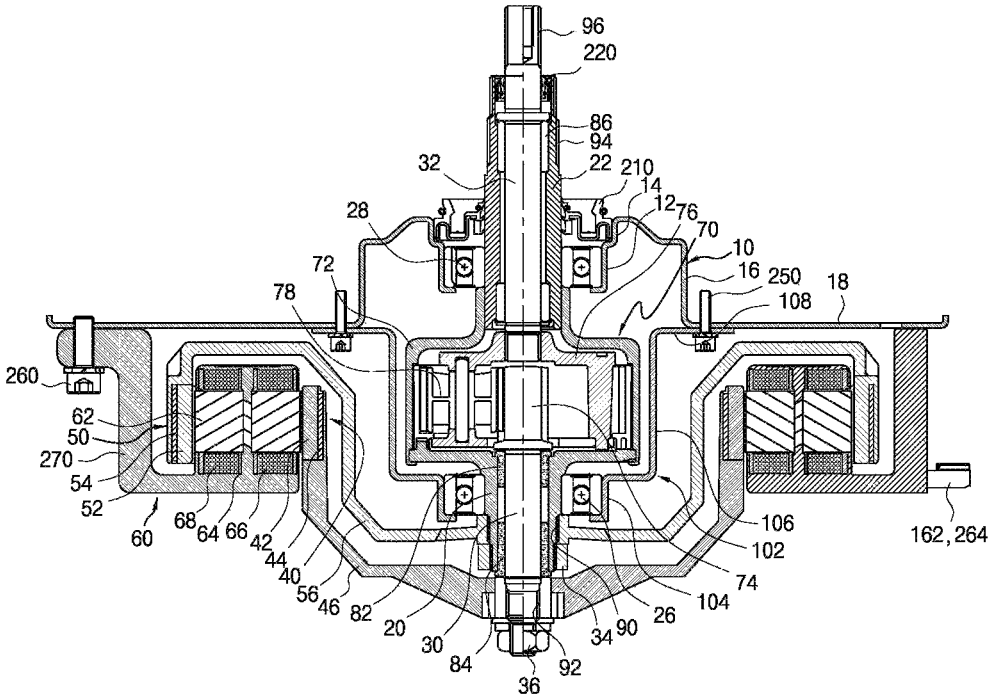
FIG. 2 is a cross-sectional view of a washing machine motor according to the first embodiment of the present invention.

FIG. 1 is a cross-sectional view of a washing machine according to a first embodiment of the present invention, and FIG. 2 is a cross-sectional view of a washing machine motor according to the first embodiment of the present invention.

Referring to FIGS. 1 and 2, a washing machine according to the first embodiment of the present invention includes: a case 100 forming an outer appearance; an outer tub 110 which is disposed in an inside of the case 100 and accommodating washing water; a washing tub 120 which is rotatably disposed inside the outer tub 110 to perform washing and dehydrating; a pulsator 130 which is rotatably disposed inside the washing tub 120 to form washing water flows; and a motor 140 which is mounted on a lower portion of the washing tub 120, to drive the washing tub 120 and the pulsator 130 simultaneously or selectively.

As shown in FIG. 2, the motor 140 includes: outer shafts 20 and 22 connected to the washing tub 120; inner shafts 30 and 32 rotatably disposed inside the outer shafts 20 and 22 and connected to the pulsator 130; an outer rotor 50 connected to the outer shafts 20 and 22; an inner rotor 40 connected to the inner shafts 30 and 32; and a stator 60 disposed between the inner rotor 40 and the outer rotor 50 with an air gap.

Any one of the inner shafts 30 and 32 and the outer shafts 20 and 22 may reduce the rotational speed and increase the torque.

In this embodiment, a planetary gear set 70 is provided in the inner shafts 30 and 32 to reduce the rotational speeds of the inner shafts 30 and 32 to increase the torque.

When the pulsator 130 is connected to the outer shafts 20 and 22, the planetary gear set 70 may be mounted on the outer shafts 20 and 22 to reduce the rotational speeds of the outer shafts 20 and 22.

The outer shafts 20 and 22 are formed in a cylindrical shape so that the inner shafts 30 and 32 pass through the outer shafts 20 and 22, respectively, and include a first outer shaft 20 coupled to the inner rotor 40, and a second outer shaft 22 coupled to the washing tub 120.

Then, the inner shafts 30 and 32 include a first inner shaft 30 coupled to the outer rotor 50 and a second inner shaft 32 coupled to the pulsator 130.

Figure 4:
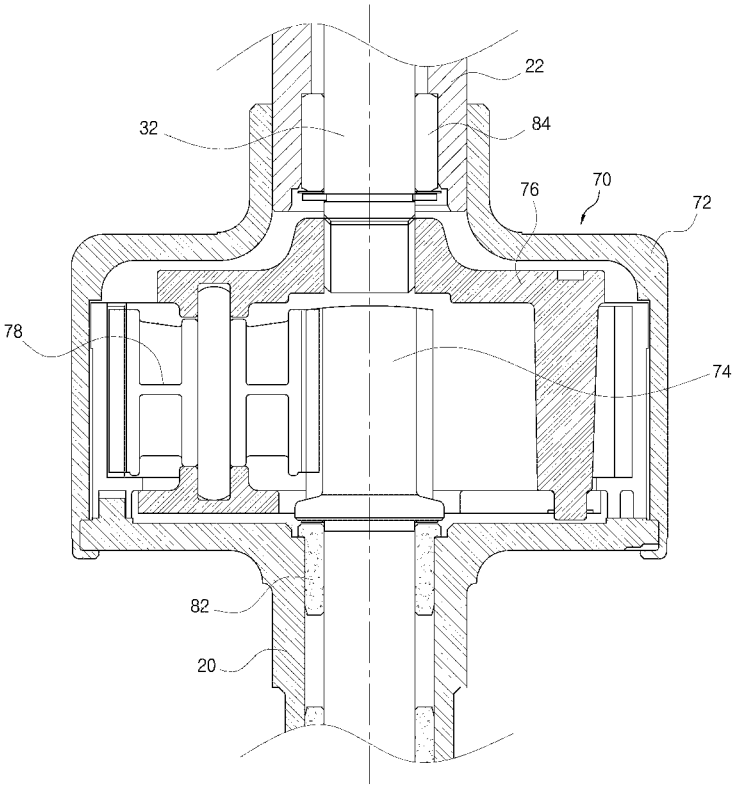
FIG. 4 is a cross-sectional view of the planetary gear set according to the first embodiment of the present invention.

As shown in FIG. 4, the planetary gear set 70 includes: a ring gear 72 connecting between the first outer shaft 20 and the second outer shaft 22; a sun gear 74 integrally coupled to the first inner shaft 30; a planetary gear 78 engaged with an outer surface of the sun gear 74 and an inner surface of the ring gear 72; and a carrier 76 to which the planetary gear 78 is rotatably supported and that is connected to the second inner shaft 32.

The planetary gear set 70 is configured so that the first outer shaft 20 and the second outer shaft 22 are connected by the ring gear 72 and thus the rotational speed of the first outer shaft 20 is transferred to the second outer shaft 22. Therefore, the rotational speed of the first outer shaft 20 is the same as that of the second outer shaft 22.

In addition, the first inner shaft 30 is formed integrally with the sun gear 74, and the second inner shaft 32 is spline-coupled with the carrier 76. The carrier 76 is rotatably supported in the center of the planetary gear 78. As a result, the rotational speed of the first inner shaft 30 is decelerated to then be transmitted to the second inner shaft 32.

In this way, the inner shafts 30 and 32 are interconnected via the planetary gear set 70 to thus decelerate the rotational speed of the inner rotor 40 to then be transmitted to the pulsator 130, to thereby increase the torque of the pulsator 130 and accordingly be applicable to a large-capacity washing machine.

A first sleeve bearing 80 and a second sleeve bearing 82 are respectively provided in a cylindrical form between an outer circumferential surface of the first inner shaft 30 and an inner circumferential surface of the first outer shaft 20, to thus rotatably support the first inner shaft 30.

A third sleeve bearing 84 and a fourth sleeve bearing 86 are provided on upper and lower inner surfaces of the second outer shaft 22, respectively, to thus rotatably support the second inner shaft 32.

A first link 90 to which an outer rotor support 56 of the outer rotor 50 is connected is formed on an outer surface of the first outer shaft 20 and a second link 92 to which an inner rotor support 46 of the inner rotor 40 is connected is formed on a lower end of the first inner shaft 30.

The first link 90 and the second link 92 may be serration-coupled or spline-coupled through protrusions formed on the outer surfaces of the first outer shaft 20 and the first inner shaft 30, or mutually key-coupled through key grooves formed on the outer surfaces of the first outer shaft 20 and the first inner shaft 30.

Here, a first locking nut 34 is screwed and coupled at the lower end of the first outer shaft 20, in which the first locking nut 34 prevents the departure of the outer rotor support 56 of the outer rotor 50 from the first outer shaft 20, and a second locking nut 36 is screwed and coupled at the lower end of the first inner shaft 30, in which the second locking nut 36 prevents the departure of the inner rotor support 46 of the inner rotor 50 from the first inner shaft 30.

A third link 94 is formed on the upper outer surface of the second outer shaft 22 in which the washing tub 120 is connected to the third link 94, and a fourth link 96 is formed on the upper outer surface of the second inner shaft 32 in which the pulsator 130 is connected to the fourth link 96.

The third link 94 and the fourth link 96 may be serration-coupled or spline-coupled through protrusions formed on the outer surfaces of the second outer shaft 22 and the second inner shaft 32, or mutually key-coupled through key grooves formed on the outer surfaces of the second outer shaft 22 and the second inner shaft 32.

A first seal 220 is mounted between the second outer shaft 22 and the second inner shaft 32 to prevent the washing water from leaking, and a second seal 210 is mounted between the second outer shaft 22 and a second bearing housing 10 to prevent the washing water from leaking.

A first bearing 26 is disposed on the outer surface of the first outer shaft 20, and a second bearing 28 is disposed on the outer surface of the second outer shaft 22, to thus rotatably support the first and second outer shafts 20 and 22.

The first bearing 26 is mounted in a first bearing housing 102 and the second bearing 28 is mounted in the second bearing housing 10.

The first bearing housing 102 is formed of a metallic material, and includes: a first bearing mount portion 104 in which the first bearing 26 is mounted; a cover portion 106 that is extended outwardly from the first bearing mount portion 104 to thus form a cylindrical shape, and that is disposed with a predetermined gap to wrap around the outer surface of the planetary gear set 70 to protect the planetary gear set 70; a flat plate portion 108 that is extended outwardly from the top of the cover portion 106 to thus form a circular plate, and to which the stator 60 and the outer tub 110 are fixed.

The flat plate portion 108 is coupled with the second bearing housing 10 with a plurality of bolts 250 in the circumferential direction of the flat plate portion 108.

The second bearing housing 10 is formed of a metallic material, and includes: a second bearing mount portion 12 in which the second bearing 28 is mounted; a second seal fastener 14 that is extended outwardly from the second bearing mount portion 12 to thus fasten the second seal 210; a link 16 that is bent downwardly from the second seal fastener 14 to thus form a cylindrical shape; and a flat plate portion 18 that is extended outwardly from a lower end of the link 16 to thus be fixed to the outer tub 110.

The flat plate portion 18 is coupled with the flat plate portion 108 of the first bearing housing 102 with bolts 250, and is fixed to a stator support 270 and the outer tub 110 with bolts 260.

Figure 5:
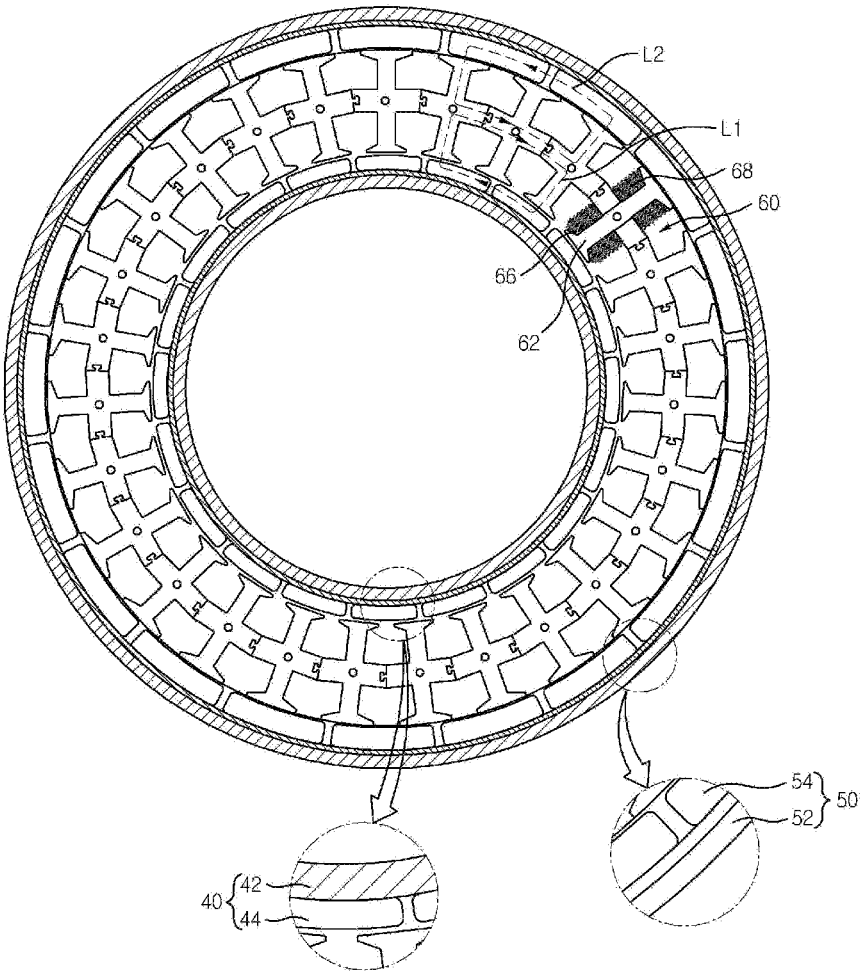
FIG. 5 is a transversal cross-sectional view of the washing machine motor according to the first embodiment of the present invention.

As shown in FIG. 5, the inner rotor 40 includes: a plurality of first magnets 42 that are disposed on the inner surface of the stator 60 with a certain gap; a first back yoke 44 disposed on the rear surfaces of the plurality of first magnets 42; and an inner rotor support 46 that is integrally formed with the first magnets 42 and the first back yoke 44 by an insert molding method.

Here, the inner rotor support 46 is integrally formed with the plurality of first magnets 42 and the first back yoke 44 by molding a thermosetting resin, for example, a BMC (Bulk Molding Compound) molding material such as polyester. Thus, the inner rotor 40 may have waterproof performance, and shorten the manufacturing process.

The inner surface of the inner rotor support 46 is connected to the second link 92 of the first inner shaft 30, and the first magnet 42 and the first back yoke 44 are fixed to the outer surface thereof.

Therefore, when the inner rotor 40 rotates, the inner shafts 30 and 32 are rotated, and the pulsator 130 that is connected to the inner shafts 30 and 32 is rotated.

Here, the pulsator 130 may be fully rotated by the torque of the inner rotor 40 due to the rotational torque that is not large.

Then, the outer rotor 50 includes: a plurality of second magnets 52 that are disposed on the outer surface of the stator 60 with a certain gap; a second back yoke 54 disposed on the rear surface of the plurality of the second magnets 52; and an outer rotor support 56 that is integrally formed with the second magnets 52 and the second back yoke 54 by an insert molding method.

Here, the outer rotor support 56 is integrally formed with the plurality of second magnets 52 and the second back yoke 54 by molding a thermosetting resin, for example, a BMC (Bulk Molding Compound) molding material such as polyester. Thus, the outer rotor 50 may have waterproof performance, and shorten the manufacturing process.

The inner surface of the outer rotor support 56 is connected to the first link 90 of the first outer shaft 20 and the outer rotor support 56 is rotated with the first outer shaft 20, and the second magnet 52 and the second back yoke 54 are fixed to the outer surface thereof.

Therefore, when the outer rotor 50 rotates, the outer shafts 20 and 22 are rotated, and the washing tub 120 associated with the outer shafts 20 and 22 is rotated.

Figure 3:
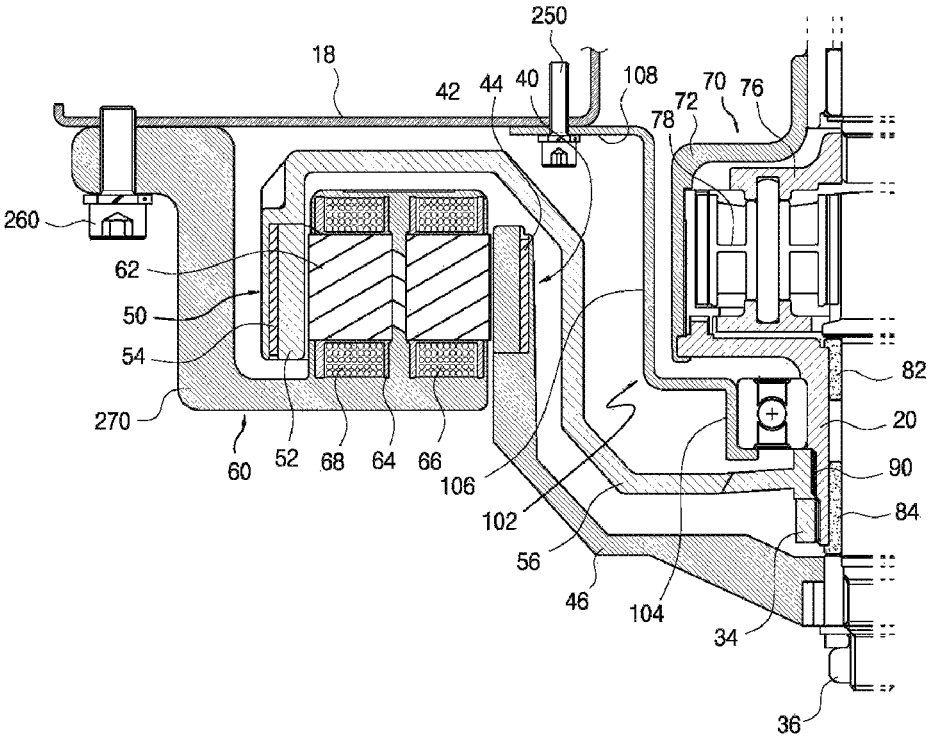
FIG. 3 is a partially enlarged cross-sectional view of the washing machine motor according to the first embodiment of the present invention shown in FIG. 2.
Figure 6:
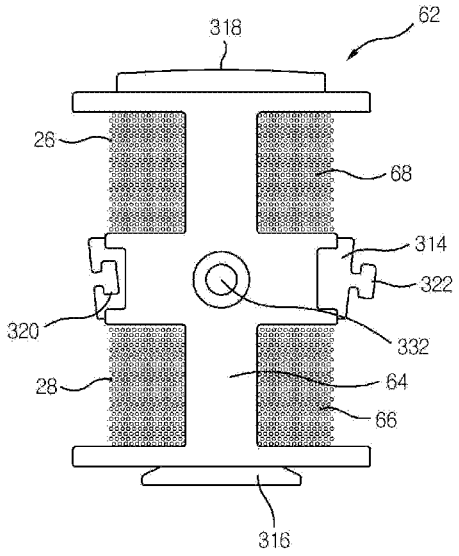
FIG. 6 is a cross-sectional view of a stator according to the first embodiment of the present invention.

As shown in FIGS. 3 and 6, the stator 60 includes: a plurality of stator cores 62 that are arranged in an annular shape; non-magnetic bobbins 64 that are configured to wrap the outer circumferential surfaces of the plurality of stator cores 62, respectively; a first coil 66 that is wound on one side of each of the stator cores 62; a second coil 68 that is wound on the other side of each of the stator cores 62; and a stator support 270 in which the plurality of stator cores 62 are arranged in an annular shape and that is fixed to the outer tub 110.

The stator support 270 is integrally formed with the stator cores 62 by an insert molding method after arranging the plurality of stator cores 62 at certain intervals in an annular form in the circumferential direction thereof in a mold.

In other words, the stator support 270 is molded by the insert molding method by molding a thermosetting resin, for example, a BMC (Bulk Molding Compound) molding material such as polyester. In this case, the plurality of stator cores 62 are arranged at certain intervals in an annular form in the circumferential direction thereof in a mold, and thus are integrally formed.

Other than the structure that the stator support 270 is integrally formed with the stator cores 62 by insert molding, the stator support 270 may be separately manufactured from the stator cores 62 and then coupled with the stator cores 62 by using bolts.

Figure 7:
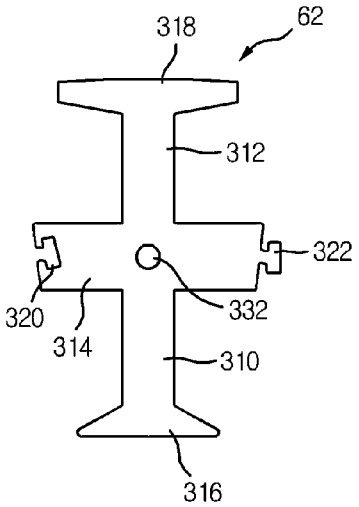
FIG. 7 is a cross-sectional view of a stator core according to the first embodiment of the present invention.

As shown in FIGS. 6 and 7, the stator core 62 includes: a first tooth portion 310 around which the first coil 66 is wound; a second tooth portion 312 that is formed on the other side of the first tooth portion 310 and around which the second coil 68 is wound; a partition 314 for partitioning between the first tooth portion 310 and the second tooth portion 312; and couplers 320 and 322 formed on both lateral ends of the partition 314 and interconnecting between the adjoining stator cores 62.

Here, a first drive signal is applied to the first coil 66 and a second derive signal is applied to the second coil 68. Accordingly, when the first drive signal is applied to only the first coil 66, only the inner rotor 40 is rotated, when the second drive signal is applied to only the second coil 68, only the outer rotor 50 is rotated, and when the first and second drive signals are applied to the first coil 66 and second coil 68, respectively, both the inner rotor 40 and outer rotor 50 are simultaneously rotated.

A throughhole 332 is formed at the center of the partition 314, to thus serve to prevent a first magnetic circuit formed by the first coil 66 and a second magnetic circuit formed by the second coil 68 from being interfered with each other. The throughhole 332 may be formed in a circular shape, but may be formed long in a slot type in the lateral direction of the partition 314.

A first flange 316 is formed at the end of the first tooth portion 310 so as to be disposed to face the first magnets 42 and a second flange 318 is formed at the end of the second tooth portion 312 so as to be disposed to face the second magnets 52.

The first flange 316 and the second flange 318 are formed to have inward and outward curved surfaces at predetermined curvatures, respectively, to correspond to the first magnet 42 of the inner rotor 40 and the second magnet 52 of the outer rotor 50. Thus, the roundness of the inner circumferential surface and the outer circumferential surface of the stator core 62 is increased and thus certain magnetic gaps may be maintained between the inner circumferential surface of the stator 60 and the first magnet 42 and between the outer circumferential surface of the stator 60 and the second magnet 52, respectively, although the inner circumferential surface and outer circumferential surface of the stator 60 are proximate to the first magnet 42 and the second magnet 52.

The stator cores 62 should have a structure of being directly connected to each other so as to form a magnetic circuit. Thus, the couplers 320 and 322 of one stator core 62 have a structure of being directly connected to the couplers 322 and 320 of another adjacent stator core 62 so that the stator cores 62 may be energized.

As an example, these couplers 320 and 322 are configured so that a coupling protrusion 322 is protrudingly formed at one side of the partition 314 and a coupling groove 320 with which a coupling protrusion 322 of a neighboring stator core 62 is fitted and coupled is formed at the other side of the partition 314. Thus, when the coupling protrusion 322 of one state core is fitted into and coupled with the coupling groove 320 of a neighboring stator core, the stator cores 62 are annularly arranged, and have a directly cross-linked structure that the stator cores 62 are directly connected with each other.

In addition to the above structure, the couplers have a structure that pinholes are formed at both end portions of the partition of each of the stator cores, and a pin member is fitted into and coupled with the pinholes of two stator cores at a state where the stator cores 62 contact each other, to thereby employ a structure of connecting between the stator cores. Alternatively, the couplers may employ a method of caulking the stator cores by using a caulking member in a state where the stator cores contact each other.

The washing machine motor according to an embodiment of the present invention forms a first magnetic circuit $L_1$ between the inner rotor 40 and one side of the stator 60 where the first coil 66 is wound, and forms a second magnetic circuit $L_2$ between the outer rotor 50 and the other side of the stator 60 where the second coil 68 is wound, to thus form a pair of magnetic circuits each independent to each other. As a result, the inner rotor 40 and the outer rotor 50 may be respectively driven separately.

More specifically, the first magnetic circuit $L_1$ includes the first magnet 42 of the N-pole, the first tooth portion 310 on which the first coil 66 is wound, an inner part of the partition 314, the adjacent first tooth portion 310, the first magnet 42 of the S-pole adjacent to the first magnet 42 of the N-pole, and the inner rotor support 46.

In addition, the second magnetic circuit $L_2$ includes the second magnet 52 of the N-pole, the second tooth portion 312 facing the second magnet 52 of the N-pole and on which the second coil 68 is wound, an outer part of the partition 314, the adjacent second tooth portion 312, the second magnet 52 of the S-pole, and the outer rotor support 56.

Figure 8:
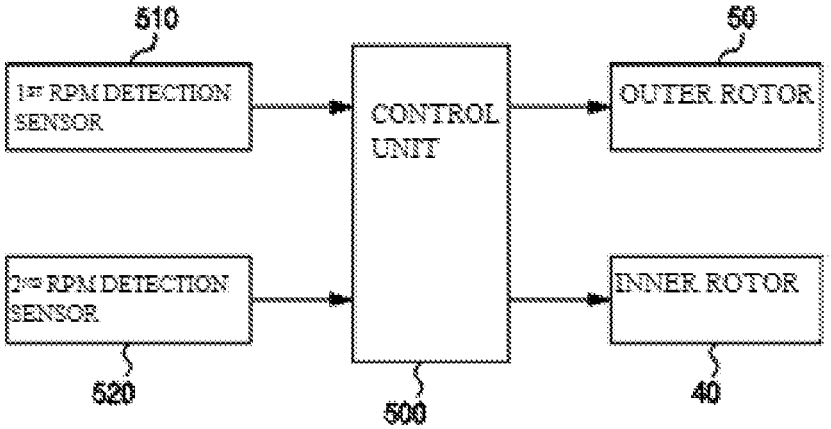
FIG. 8 is a block diagram of a control unit according to the first embodiment of the present invention.
Figure 9:
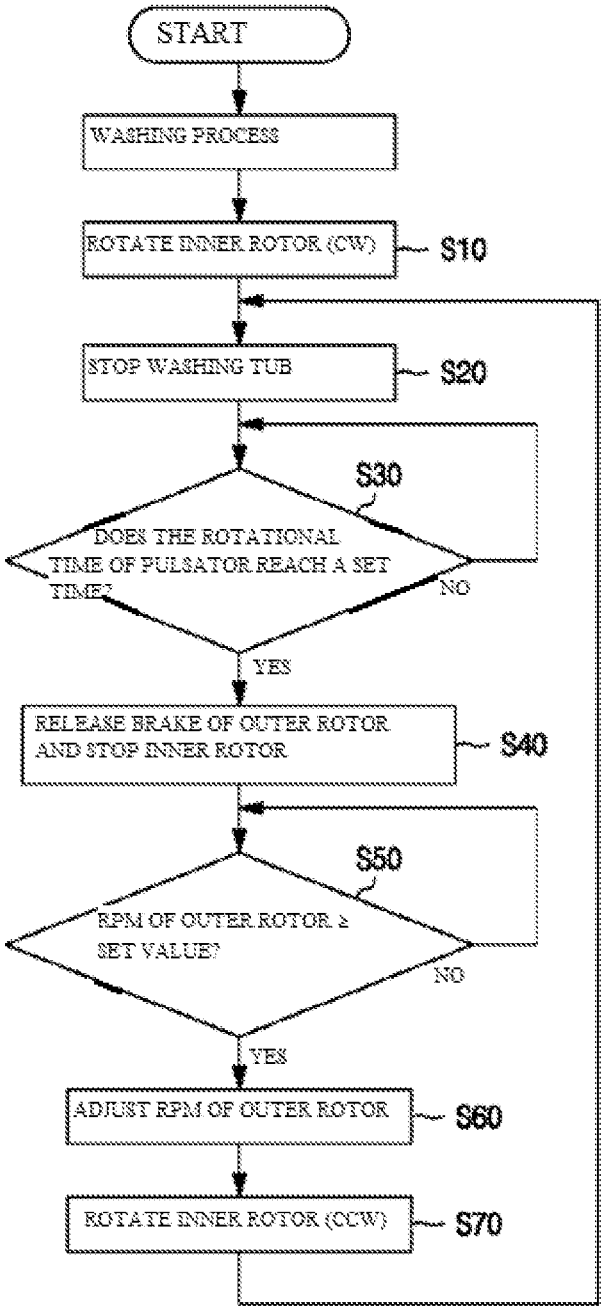
FIG. 9 is a flowchart illustrating a washing machine operating method according to the first embodiment of the present invention.

FIG. 8 is a block diagram of a washing machine control unit according to the first embodiment of the present invention, and FIG. 9 is a flowchart illustrating a washing machine operating method according to the first embodiment of the present invention.

The method of operating the washing machine according to the first embodiment will be described with respect to a method of implementing a dual-power during a washing operation of the washing machine.

First, in the washing process, the inner rotor is rotated in the clockwise (CW) direction (S10). That is, when a first drive signal is forwardly applied to the first coil 66, the inner rotor 40 is rotated clockwise (CW), and the first inner shaft 30 connected to the inner rotor 40 is rotated. The rotational speed is reduced by the planetary gear set 70 connected to the first inner shaft 30 to then be transmitted to the second inner shaft 32, and the pulsator 130 connected to the second inner shaft 32 is rotated clockwise (CW).

In this case, the ring gear 72 of the planetary gear set 70 is engaged with the outer shafts 20 and 22 and the washing tub 120 when the laundry is absent in the washing tub 120 or the laundry is less than a set value (when there is no load or less load on the pulsator 130) to thus perform a brake operation, and therefore the rotational force of the inner rotor 40 is input to the sun gear 74 and is output to the carrier 76. Thus, the pulsator 130 connected to the carrier 76 is rotated.

That is, when there is no laundry in the washing tub 120 or the laundry is less than the set value, the rotational force of the inner rotor 40 is transmitted to the pulsator 130 to rotate the pulsator 130.

When a certain amount of laundry is charged into the washing tub 120, the pulsator 130 is loaded, and the carrier 76 connected to the pulsator 130 acts as a brake. The rotational force of the inner rotor 40 is input to the sun gear 74 and is output to the ring gear 72 so that the washing tub 120 and the outer rotor 50 connected to the ring gear 72 rotate counterclockwise (CCW).

Rotation of the washing tub 120 is detected and the washing tub 120 is stopped the washing tub 120 is rotated for a set time, so that the rotational force of the inner rotor 40 is transmitted to the pulsator 130 (S20).

That is, the control unit 500 determines the rotation and rotational direction of the outer rotor 50, according to a signal applied from a first RPM sensor 510 provided on one side of the outer rotor 50 to detect the RPM of the outer rotor 50, and applies a second drive signal forwardly to the second coil 68 when the outer rotor 50 is rotated for a set time, so that an electromagnetic brake installed in the outer rotor 50 is operated as a brake, or the outer rotor 50 is rotated in the same clockwise (CW) direction as that of the inner rotor 40.

Then, the outer rotor 50 is stopped from being rotated counterclockwise (CCW), and the washing tub 120 is stopped. Here, the ring gear 72 acts as a brake, the sun gear 74 plays a role of an input, and the carrier 76 plays a role of an output. Thus, the rotational force of the inner rotor 40 is transmitted to the pulsator 130, so that the pulsator 130 is rotated.

In this way, during a time interval when the washing tub 120 is stopped and the pulsator 130 is rotated, a dual-power is implemented to thus improve washing efficiency. In other words, since the pulsator 130 is rotated during a time interval when the washing tub 120 is stopped, the washing tub 120 and the pulsator 130 may be rotated in opposite directions to each other, to thus implement a dual-power to thereby improve washing efficiency.

Then, when the pulsator 130 is rotated for a set time, the braking action of the electromagnetic brake or the like of the outer rotor 50 is released, and then the inner rotor 40 is stopped (S30 and S40). In this case, when the RPM of the outer rotor 50 is detected and then it is determined that the RPM of the outer rotor 50 is a set value or higher, the RPM of the outer rotor 50 is adjusted by using the electromagnetic brake or the like (S50 and S60).

Here, during the time when the pulsator 130 is gradually slowly rotated to stop, the washing tub 120 is rotated to thus implement dual-power. In addition, since, when the pulsator 130 is stopped, the washing tub 120 is rotated, at least one of the pulsator 130 and the washing tub 120 continues to rotate. As a result, there is no interval that the washing machine stops during the washing operation to improve the washing efficiency.

In addition, when rotating the inner rotor 40 again in the counterclockwise (CCW) direction, the above-described process is repeated, to thereby rotate the pulsator reversely (S70).

In this way, the pulsator is repeatedly rotated forwardly and reversely to thus perform the washing stroke. In this case, when the pulsator is stopped so as to be rotated in the reverse direction, the washing tub is rotated to thereby improve the washing efficiency.

Then, when the washing cycle is completed, a detangling cycle, a dewatering cycle, and the like are performed.

Figure 10:
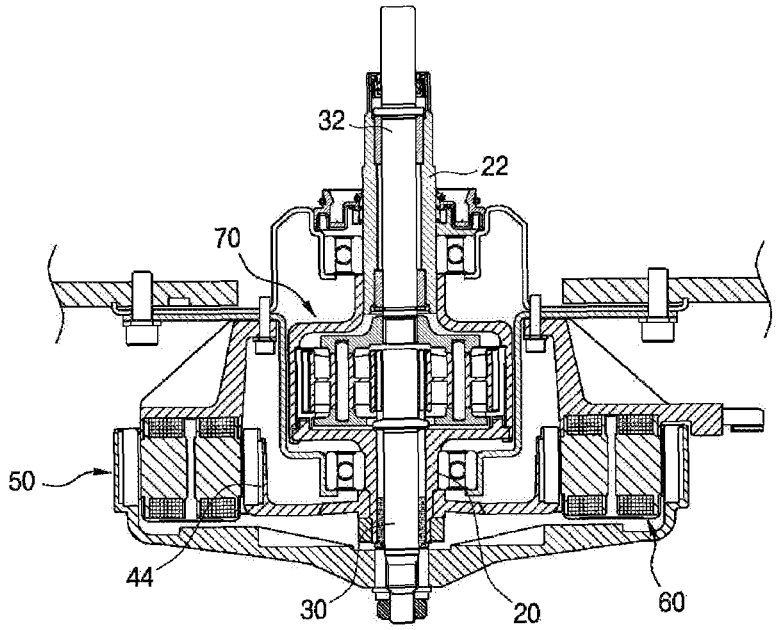
FIG. 10 is a cross-sectional view of a washing machine motor according to a second embodiment of the present invention.

FIG. 10 is a cross-sectional view of a washing machine motor according to a second embodiment of the present invention.

The washing machine motor according to the second embodiment includes: outer shafts 20 and 22 connected to a washing tub 120; inner shafts 30 and 32 rotatably disposed inside the outer shafts 20 and 22 and connected to the pulsator 130; an inner rotor 40 connected to the outer shafts 20 and 22; an outer rotor 50 connected to the inner shafts 30 and 32, a stator 60 disposed with a gap between the inner rotor 40 and the outer rotor 50; and a planetary gear set 70 disposed on the inner shafts 30 and 32 to reduce the rotational speeds of the inner shafts 30 and 32, to thereby increase the torque thereof.

The washing machine according to the second embodiment as described above, is the same as the washing machine motor according to the first embodiment described above. However, in the washing machine motor according to the second embodiment, the washing tub 120 and the inner rotor 40 are connected to each other by the planetary gear set 70, and the pulsator 130 and the outer rotor 50 are connected to each other by the planetary gear set 70. Accordingly, the rotational force of the outer rotor 50 is transmitted to the pulsator 130 and the rotational force of the inner rotor 40 is transmitted to the washing tub 120.

The method of operating the washing machine by using the washing machine motor according to the second embodiment is the same as that of the first embodiment described above. However, in the washing machine operating method according to the first embodiment, the rotational force of the inner rotor 40 is transmitted to the pulsator 130 and the rotational force of the outer rotor 50 is transmitted to the washing tub 120, while, in the washing machine operating method according to the second embodiment, the rotational force of the outer rotor 50 is transmitted to the pulsator 130 and the rotational force of the inner rotor 40 is transmitted to the washing tub 120.

While the present invention has been particularly shown and described with reference to the preferred embodiments thereof, it is to be understood that the invention is not limited to the disclosed embodiments, but, on the contrary, various changes and modifications may be made by those skilled in the art.

INDUSTRIAL APPLICABILITY

The present invention can be applied to a washing machine capable of independently driving a pulsator and a washing tub and capable of realizing a dual-power and forming various water flow patterns.

The invention claimed is:

1. A method of operating a washing machine, in which a washing tube disposed inside an outer tub is connected with an outer rotor of a motor though an outer shaft, a pulsator disposed inside the washing tub is connected with an inner rotor of the motor through an inner shaft disposed inside the outer shaft, and a planetary gear set is operatively connected with the inner shaft and the outer shaft to reduce a rotational speed of the inner shaft, the method comprising the steps of:

charging an amount of laundry into the washing tub;

rotating the inner rotor in a clockwise (CW) direction and releasing the outer rotor to a free-rotation state, wherein, by both a load of the laundry and operation of the planetary gear set, the washing tube is rotated in a counterclockwise (CCW) direction;

after a first set time, rotating the outer rotor in the CW direction, wherein, by operation of the planetary gear set, a CW rotational force of the inner rotor is transmitted to the pulsator, and the CCW rotation of the washing tub is gradually stopped, thereby the pulsator and the washing tub being rotated in opposite direction during the gradual stop of the washing tub;

releasing the outer rotor again to a free-rotation state when a rotational time of the pulsator reaches a second set time; and rotating the inner rotor in a counterclockwise (CCW) direction to repeat the above operational mode in vice-versa.

2. The method of claim 1, wherein, when rotating the outer rotor in the CW direction, a ring gear of the planetary gear set connected to the outer rotor acts as a brake and an input applied to a sun gear of the planetary gear set connected to the inner rotor is outputted to a carrier associated with the pulsator through a planetary gear of the planetary gear set.

3. The method of claim 1, wherein the rotating of the outer rotor in the CW direction comprises: adjusting RPM (revolution per minute) of the outer rotor to a set value or less.

4. A method of operating a washing machine, in which a washing tube disposed inside an outer tub is connected with an inner rotor of a motor though an outer shaft, a pulsator disposed inside the washing tub is connected with an outer rotor of the motor through an inner shaft disposed inside the outer shaft, and a planetary gear set is operatively connected with the inner shaft and the outer shaft to reduce a rotational speed of the inner shaft, the method comprising the steps of:

charging an amount of laundry into the washing tub;

rotating the outer rotor in a clockwise (CW) direction and releasing the inner rotor to a fee-rotation state, wherein by both a load of the laundry and operation of the planetary gear set, the washing tube is rotated in a counterclockwise (CCW) direction;

after a first set time, rotating the inner rotor in the CW direction, wherein, by operation of the planetary gear set, a CW rotational force of the outer rotor is transmitted to the pulsator, and the CCW rotation of the washing tub is gradually stopped, thereby the pulsator and the washing tub being rotated in opposite direction during the gradual stop of the washing tub;

releasing the inner rotor again to a free-rotation state when a rotational time of the pulsator reaches a second set time; and rotating the outer rotor in a counterclockwise (CCW) direction to repeat the above operational mode in vice-versa.

* * * * *